US006926228B2

(12) United States Patent
Wik

(10) Patent No.: US 6,926,228 B2
(45) Date of Patent: Aug. 9, 2005

(54) METHOD AND ARRANGEMENT FOR EXTENDING THE RANGE OF FIRE OF A FIN-STABILIZED ARTILLERY MISSILE

(75) Inventor: Torsten Wik, Karlskoga (SE)

(73) Assignee: Bofors Defence AB, Karlskoga (SE)

( * ) Notice: Subject to any disclaimer, the term of this patent is extended or adjusted under 35 U.S.C. 154(b) by 0 days.

(21) Appl. No.: 10/363,636

(22) PCT Filed: Aug. 24, 2001

(86) PCT No.: PCT/SE01/01800

§ 371 (c)(1),
(2), (4) Date: Sep. 10, 2003

(87) PCT Pub. No.: WO02/21069

PCT Pub. Date: Mar. 14, 2002

(65) Prior Publication Data

US 2004/0094660 A1 May 20, 2004

(30) Foreign Application Priority Data

Sep. 5, 2000 (SE) ..... 0003115

(51) Int. Cl.[7] ..... F42B 10/37
(52) U.S. Cl. ..... 244/3.24; 244/3.27

(58) Field of Search ..... 244/3.24, 3.27, 244/3.28, 3.29, 35 R

(56) References Cited

U.S. PATENT DOCUMENTS

| | | | | | |
|---|---|---|---|---|---|
| 3,085,511 | A | * | 4/1963 | Donner | 244/3.24 |
| 3,756,539 | A | | 9/1973 | Donner et al. | |
| 4,158,447 | A | * | 6/1979 | Humphries et al. | 244/3.27 |
| 4,332,360 | A | * | 6/1982 | Topliffe | 244/3.27 |
| 4,978,088 | A | | 12/1990 | Himmert et al. | |
| 5,062,585 | A | * | 11/1991 | Mikhail | 244/3.24 |
| 5,779,189 | A | * | 7/1998 | Hamstra et al. | 244/53 B |
| 5,871,174 | A | * | 2/1999 | Hannay | 244/35 R |
| 5,901,925 | A | * | 5/1999 | McGrath et al. | 244/45 A |
| 6,454,205 | B2 | * | 9/2002 | Niemeyer et al. | 244/3.26 |

* cited by examiner

*Primary Examiner*—Tien Dinh
(74) *Attorney, Agent, or Firm*—Connolly Bove Lodge & Hutz LLP; Larry J. Hume

(57) ABSTRACT

Method and arrangement for extending the range of fire of a fin-stabilized artillery missile. The fin-stabilized artillery missile (1), which is fired in a ballistic trajectory, has fins (3–6), which have been given a sawtooth-shaped leading wing edge (7) that has been found to give the missile (1) an extended range of fire and improved manoeuvrability.

14 Claims, 1 Drawing Sheet

Figure 1:
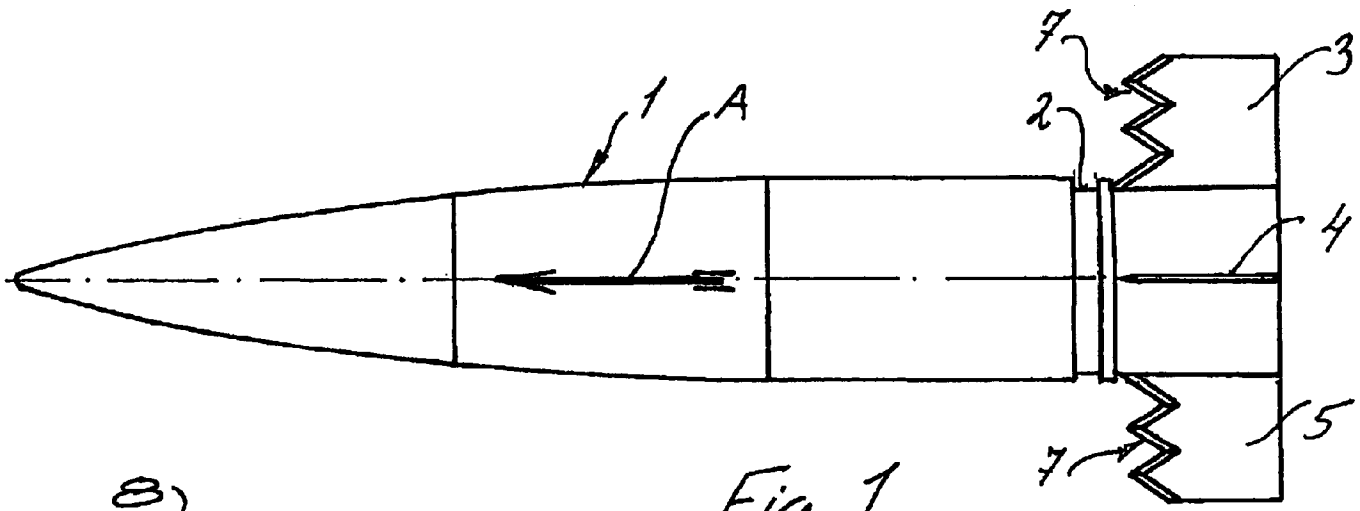

METHOD AND ARRANGEMENT FOR EXTENDING THE RANGE OF FIRE OF A FIN-STABILIZED ARTILLERY MISSILE

The present invention relates to a fin-stabilized artillery missile which is fired in a ballistic trajectory and whose stabilizing fins have been given a specific configuration that has been found to give the missile an extended range of fire and improved manoeuvrability.

Artillery missiles fired in ballistic trajectories are normally stabilized in their trajectory either by rotation stabilization, where the required rotation is preferably obtained in a rifled barrel, or with the aid of suitably adapted fins, where the fins, if the firing takes place from the barrel of a gun or howitzer or the like, have to be kept retracted during the actual firing phase and are deployed only after the missile has completely exited the barrel. Moreover, if a missile intended for fin stabilization of its trajectory is to be fired from a rifled barrel, this must be done either by the missile being provided with a drive band which completely eliminates or to a great extent limits the rotation which the missile experiences on its travel through the barrel, or the rotation of the missile has to be decelerated before the fins can be deployed unless the fins are also used for decelerating the rotation, but extra strong fins are then needed. In many cases it may also be necessary, before deployment of the fins, to decelerate the rotation of missiles fired using drive bands.

When correctly configured, fin-stabilized missiles fired in ballistic trajectories, such as artillery shells, can be given good ranges of fire by means of the fins contributing with an aerodynamic lifting force, which in turn increases the range of fire of the missile.

In addition, it is much easier to correct the trajectory of a fin-stabilized shell than that of a rotation-stabilized shell. This reason for choosing to fin-stabilize artillery shells has become all the more important since great advances in recent years in the field of microelectronics have made it easier to provide artillery shells even of medium calibre with their own homing devices or remote controls which, coupled with active trajectory correction systems, result in extremely efficient independently guided or remote-control-guided missiles.

The problem which the present invention is intended to solve is that of making available a novel type of stabilizing fin for fin-stabilized shells, which contributes with the greatest possible lifting force.

The fins of shells fired from barrels must be able to be retracted during the firing phase and, in their retracted position or for their retracting function, they must not take up too much of the space inside the shell, since this space must be available for the payload. The requirement to the effect that the fins are to be retractable and take up the least possible space must additionally be combined with the fact that the fins in their retracted positions must be able to withstand the high acceleration stresses to which they and the shell are subjected during firing. Increasing the lifting force of the fins with, for example, movable leading edge flaps which require many fragile components, is therefore not a solution to the problem.

According to the laws of aerodynamics, the lifting force of a wing in principle increases in proportion to the wing surface and at a certain limit to the attitude angle (the angle between the wing surface and the velocity vector). This limit is called the stalling angle.

In the present case it is not possible, for reasons of space, to increase the surface area. A maximum surface area for a given space is obtained using a rectangular wing shape. However, this wing shape gives a low stalling angle and thus a low maximum lifting force, especially if the wing cannot be made thin, for reasons relating to strength.

A known method for increasing the stalling angle is to have the leading edge of the wing sweep back strongly. In this application, this solution would lead to a considerably reduced wing surface and thus a poorer lifting force. Another known method is to apply so-called strakes in front of the wing. This too is not possible here for reasons of space.

Instead, according to the present invention, the leading edges of the fins viewed in the direction of flight of the missile are given a configuration which deviates from the straight line in their plane and which gives the fins extended leading edges, while at the same time the fin area is given subsidiary areas which extend forwards in the direction of flight and are separated by empty spaces or recesses arranged between them and extending rearwards in the direction of flight. The fin thus has a roughly sawtooth-shaped leading edge, and a sawtooth-shaped leading wing edge according to the invention gives a very high stalling angle with a minimum reduction in the wing surface area.

We have found that the optimum design of such fins with a sawtooth-shaped leading edge is one in which each tooth or subsidiary area and the empty spaces arranged between them have the same triangular shape. This triangular shape can advantageously be equilateral and the toothing must not be too fine since the advantages are then lost. Although it may be difficult to set absolute limits, we have nevertheless observed that the length of the triangular forwardly extending subsidiary areas ought to lie somewhere between ⅓ and ⅙ of the full width of the fin. This means that each fin designed according to the invention will have a plurality of teeth, if the word plurality is, as here, taken to mean at least two teeth.

Also, the fins according to the invention can be produced from whole metal sheets in which the leading edges of the triangular subsidiary areas have been honed until they are knife-sharp in order to offer the least possible air resistance. In their deployed position during the firing phase, the fin plates can then be rolled around the missile body and can be covered in a known manner by a removable protective hood.

By taking the fins of older fin-stabilized artillery shells with straight leading edges and replacing them with the fins described in general terms above with sawtooth-shaped leading edges, we have been able, while keeping the fin surface area unchanged, to extend the range of fire of the shells by 5 –8%, and, since we have at the same time found that it is easier to correct the course of fins with sawtooth-shaped leading edges, we believe that it will therefore be possible to increase their range of fire still further.

Figure 2:
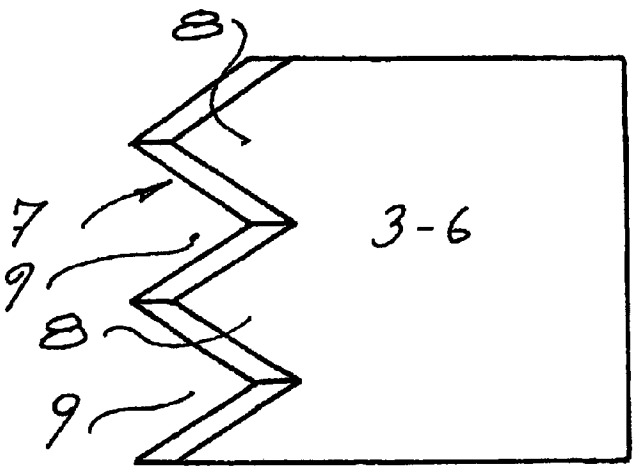
Figure 3:
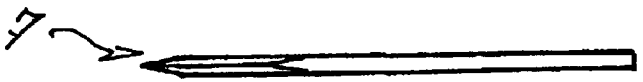

The invention has been defined in the attached patent claims and it will now be described in slightly more detail in connection with the attached figures, where FIG. 1 shows a side view of a fin-stabilized artillery shell, and FIG. 2 shows, on a larger scale, the broad side of an associated fin, while FIG. 3 shows an end view of the fin according to FIG. 2.

The shell 1 shown in FIG. 1, with direction of flight A, is provided with a band track 2 for a drive band which has been used for firing the shell from the gun or howitzer for which it is intended. Since the figure shows the shell after firing, the band, which by then has fulfilled its task, has left its band track, and the same applies to the hood which during firing is assumed to have covered the retracted fins 3–6 (the fin 6 is concealed in FIG. 1). During firing, the fins 3–6 are assumed to have been curved down towards and arranged closely along the periphery of the shell body and to have been covered by the aforementioned hood. The fins 3–6 are also assumed to have been made of a resilient material with such a good storage stability that even after many years in storage they are able to quickly resume their intended shape after firing and as soon as the protective hood has been removed. As will be seen in particular from FIG. 2, the various fins have sawtooth-shaped leading edges 7 comprising a number of triangular subsidiary areas 8 which extend forwards in the direction of flight A and which, in the example shown in the figure, have the shape of equilateral triangles separated by similarly equilateral triangular recesses 9. In addition, the leading edges 7 are sharp-edged in order to offer the least possible air resistance.

What is claimed is:

1. A method of firing a fin-stabilized artillery missile from a gun, comprising:

providing a fin-stabilized artillery missile comprising a shell body and a plurality of fins arranged around a periphery of the shell body, wherein the fins have sawtooth-shaped leading edges; and firing the shell, wherein the fins deploy from their positions around the periphery of the shell body upon firing, wherein each fin has at least two teeth along its sawtooth-shape leading edge, and wherein the fins comprise a plurality of triangularly-shaped subsidiary areas which extend forward in a direction of flight of the missile, the subsidiary areas being separated by triangular recesses.

2. The method of claim 1, comprising:

correcting a course of the missile using the fins.

3. The method of claim 1, further comprising concealing the plurality of fins before firing the fin-stabilized artillery missile from the gun, and uncovering the plurality of fins after firing the fin-stabilized artillery missile from the gun.

4. The method of claim 3, wherein the fins comprise a resilient material and, before firing the fin-stabilized artillery missile from the gun, the fins are rolled around the shell body.

5. The method of claim 2, wherein the shell body includes a band tack arranged around a circumference of the shell body.

6. The method of claim 2, wherein the subsidiary areas extend forward between about one sixth to one third of a width of a fin.

7. The method of claim 4, wherein the subsidiary areas extend between forward about one sixth to one third of a width of a fin.

8. A fin-stabilized artillery missile, comprising:

a shell body; and a plurality of fins arranged around a periphery of the shell body, wherein the fins have sawtooth-shaped leading edges, and wherein the fins are deployable from their positions around the periphery of the shell body upon firing of the missile wherein each fin has at least two teeth along its sawtooth-shaped leading edge, wherein the fins comprise a plurality of triangularly-shaped subsidiary areas which extend forward in a direction of flight of the missile, the subsidiary areas being separated by triangular recesses.

9. The missile of claim 8, wherein the fins comprise a resilient material and are rolled around the shell body.

10. The missile of claim 8, wherein the shell body includes a band track arranged around a circumference of the shell body.

11. The missile of claim 8, wherein the leading edges are knife edges.

12. The missile of claim 8, wherein the subsidiary areas extend forward between about one sixth to one third of a width of a fin.

13. The missile of claim 9, wherein:

the shell body has a band track arranged around a periphery of the shell body;

the leading edges are knife edges; and the subsidiary areas extend forward between about one sixth to one third of a width of a fin.

14. A fin-stabilized artillery missile, comprising:

a shell body having a band track arranged around a periphery of the shell body;

a plurality of fins arranged around a different periphery of the shell body, wherein the fins have sawtooth-shaped leading edges; and the fins being rolled around the shell body when the missile is in an unfired condition, wherein each fin has at least two teeth along its sawtooth-shaped leading edge comprising a plurality of triangularly-shaped subsidiary areas which extend forward in a direction of flight of the missile, the subsidiary areas being separated by triangular recesses, and wherein the fins are deployable from their positions around the periphery of the shell body upon firing of the missile.

* * * * *